US011808421B2

(12) United States Patent
Kleinkes et al.

(10) Patent No.: US 11,808,421 B2
(45) Date of Patent: Nov. 7, 2023

(54) HIGH-RESOLUTION HEADLIGHT FOR A MOTOR VEHICLE HAVING MATRIX OF LED LIGHT SOURCES GENERATING A PIXELATED LIGHT DISTRIBUTION

(71) Applicant: HELLA GmbH & Co. KGaA, Lippstadt (DE)

(72) Inventors: Michael Kleinkes, Marl (DE); Ingo Moellers, Rietberg (DE); Wolfgang Pohlmann, Lippstadt (DE); Carsten Wilks, Lippstadt (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/827,106

(22) Filed: May 27, 2022

(65) Prior Publication Data

US 2022/0290827 A1 Sep. 15, 2022

Related U.S. Application Data

(63) Continuation of application No. PCT/EP2020/080952, filed on Nov. 4, 2020.

(30) Foreign Application Priority Data

Nov. 28, 2019 (DE) ..... 102019132236.7

(51) Int. Cl.
*F21S 41/153* (2018.01)

(52) U.S. Cl.
CPC ..... *F21S 41/153* (2018.01)

(58) Field of Classification Search
CPC ..... F21S 41/153
See application file for complete search history.

(56) References Cited

U.S. PATENT DOCUMENTS 7,178,959 B2 2/2007 Capello et al.
8,646,956 B2 2/2014 Hering et al.
(Continued)

FOREIGN PATENT DOCUMENTS

DE 102008025397 A1 12/2009
DE 102015016375 A1 6/2017
(Continued)

OTHER PUBLICATIONS

International Search Report dated Feb. 4, 2021 in corresponding application PCT/EP2020/080952.

*Primary Examiner* — Robert J May
(74) *Attorney, Agent, or Firm* — Muncy, Geissler, Olds & Lowe , P.C.

(57) ABSTRACT

An illuminating device for a motor vehicle, in particular, a high-resolution headlamp for a motor vehicle, comprising an LED light source having a plurality of LED elements, whose light outlet surfaces are used for the targeted generation of pixels of a light distribution generated in the outer region of the motor vehicle during the operation of the illuminating device, the light outlet surfaces being arranged in a matrix-like manner in a first direction and in a second direction perpendicular to the first direction, the first direction corresponding to the horizontal direction in the light distribution generated in the outer region of the motor vehicle, and the second direction corresponding to the vertical direction in the light distribution generated in the outer region of the motor vehicle, and the light outlet surfaces at least of a plurality of LED elements each being larger in the first direction than in the second direction.

15 Claims, 6 Drawing Sheets

(56) References Cited

U.S. PATENT DOCUMENTS

| | | | | |
|---|---|---|---|---|
| 9,739,458 | B2 | 8/2017 | Miyachi et al. | |
| 11,187,392 | B2 | 11/2021 | Groetsch et al. | |
| 2018/0245761 | A1* | 8/2018 | Tsuji | F21S 41/143 |
| 2019/0145596 | A1 | 5/2019 | Suetsugu | |
| 2021/0162913 | A1 | 6/2021 | Neukam | |
| 2022/0128210 | A1* | 4/2022 | Huester | F21S 41/645 |

FOREIGN PATENT DOCUMENTS

| | | | |
|---|---|---|---|
| DE | 102016210048 | A1 | 12/2017 |
| DE | 102017211430 | A1 | 1/2019 |
| DE | 102017128125 | A1 | 5/2019 |
| EP | 1505660 | A1 | 2/2005 |
| EP | 3026705 | A1 | 6/2016 |
| JP | 2017193257 | A | 10/2017 |

* cited by examiner

HIGH-RESOLUTION HEADLIGHT FOR A MOTOR VEHICLE HAVING MATRIX OF LED LIGHT SOURCES GENERATING A PIXELATED LIGHT DISTRIBUTION

This nonprovisional application is a continuation of International Application No. PCT/EP2020/080952, which was filed on Nov. 4, 2020, and which claims priority to German Patent Application No. 10 2019 132 236.7, which was filed in Germany on Nov. 28, 2019, and which are both herein incorporated by reference.

BACKGROUND OF THE INVENTION

Field of the Invention

The present invention relates to an illuminating device for a motor vehicle, in particular, a high-resolution headlamp for a motor vehicle.

Description of the Background Art

An illuminating device is known from EP 3 026 705 A1, which corresponds to US 2016/0144771. In the illuminating device described therein, LED elements in a matrix arrangement are used as the LED light source for the targeted generation of pixels of a light distribution generated in the outer region of the motor vehicle. The light outlet surfaces of the individual LED elements are provided with a square design.

In pixelated LED light sources for matrix LED light modules in headlamps, square pixels usually have a size of 40 μm or larger. The aspect ratio of the entire luminous surface of the LED light source formed by the light outlet surfaces of the LED elements is furthermore 4 to 1 between the horizontal and vertical directions. By projecting the luminous surface onto the road, narrow and long pixel projections result on the road in the case of square pixels having a non-anamorphically imaging projection optical element. However, to usefully project symbols, the pixels projected onto the road should tend to be wide in the horizontal direction and short in the vertical direction.

SUMMARY OF THE INVENTION

It is therefore an object of the present invention to provide an illuminating device, which permits a projection of graphic symbols onto the road with little loss of efficiency.

According to an exemplary embodiment, it is provided that the light outlet surfaces of at least a plurality of the LED elements are each larger in the first direction than in the second direction. Due to light outlet surfaces of LED elements which are larger in a direction corresponding to the horizontal direction in the outer region than in the direction perpendicular thereto, a projection of graphic symbols onto the road may be achieved, in which the projected pixels are wider in the horizontal direction and shorter in the vertical direction.

It may be provided that the light distribution generated in the outer region of the motor vehicle during the operation of the illuminating device has a width in the horizontal direction which corresponds to an angle range between −7° to +7° and −15° to +15°, in particular, to an angle range from −10° to +10°. It may furthermore be provided that the light distribution generated in the outer region of the motor vehicle during the operation of the illuminating device has a height in the vertical direction which corresponds to an angle range between −5° to −3° and −8° to +4°, in particular, to an angle range from −6° to +2°. The horizontal width may be selected, in particular, depending on the luminance and resolution requirements, taking into account the effect on the angle resolution per pixel.

It is possible that the luminous surface of the LED light source formed by the light outlet surfaces of the LED elements has an aspect ratio between 10 to 7.5 and 10 to 2.5 between the first and second directions or the horizontal and vertical directions in the outer region, in particular, an aspect ratio of 10 to 4 between the first and second directions or the horizontal and vertical directions in the outer region. In the case of the aforementioned aspect ratios, a preferably high efficiency should be achieved at a reasonable illumination intensity and simultaneously at the greatest possible and reasonable pixel or angle resolutions.

It may be provided that the luminous surface formed by the light outlet surfaces of the LED elements has a size between 15 $mm^2$ and 50 $mm^2$, preferably a size of 40 $mm^2$. In particular, the number of pixels in the light distribution generated during the operation of the illuminating device in the outer region of the motor vehicle may be between 20,000 and 50,000, for example 40,000, pixels. Graphic symbols having a high resolution may be represented thereby on the road.

It is possible that the light outlet surfaces of the plurality of LED elements, which are each larger in the first direction than in the second direction, have an aspect ratio between 5 to 2 and 3 to 2 between the first and second directions or the horizontal and vertical directions in the outer region, in particular, an aspect ratio of 4 to 2 between the first and second directions or the horizontal and vertical directions in the outer region. In particular, the pixel geometries and the luminous surface of the entire LED light source formed by the light outlet surfaces of the LED elements may be combined in such a way that the lowest possible efficiency losses due to tilting effects in the LED elements may be expected.

In may be provided that the LED light source is designed as a solid-state LED array or comprises a solid-state LED array.

It is possible that the light outlet surfaces of a first plurality of the LED elements are each larger in the first direction than in the second direction, and the light outlet surfaces of a second plurality of the LED elements are each not larger in the first direction than in the second direction, in particular, the light outlet surfaces of the second plurality of LED elements each being the same size in the first direction and in the second direction. In particular, the light outlet surfaces of the first plurality of LED elements in the first direction may be arranged differently with respect to the light outlet surfaces of the second plurality of LED elements in such a way that the pixels generated by the first plurality of LED elements are arranged below the pixels generated by the second plurality of LED elements in the vertical direction in the light distribution generated in the outer region of the motor vehicle. As a result, in the upper light distribution, in particular, above the light/dark boundary, particularly efficient and bright pixels are used, which do not have to be flat. Square light outlet surfaces of the LED elements may preferably be used for these pixels. For the portion of the light distribution below the light-dark boundary, flatter and wider pixels generated by rectangular light outlet surfaces may be generated to optimize the projection of symbols.

It may be provided that the light outlet surfaces of the first plurality of LED elements are arranged in the first direction in such a way that the pixels generated by the first plurality of LED elements are arranged in an angle range from −8° to 0°, in particular, in an angle range from −6° to −°, in the vertical direction in the light distribution generated in the outer region of the motor vehicle. It may furthermore be provided that the light outlet surfaces of the second plurality of LED elements are arranged in the first direction in such a way that the pixels generated by the second plurality of LED elements are arranged in an angle range from −3° to +4°, in particular, in an angle range from −1° to +2°, in the vertical direction in the light distribution generated in the outer region of the motor vehicle. In particular, the light/dark boundary in common headlamps is arranged approximately in the range between −1° and 0°, for example at approximately −0.57°.

It is possible that the illuminating device comprises an integrated circuit for controlling the LED elements, in particular, an application-specific integrated circuit (ASIC), the first plurality of LED elements and the second plurality of LED elements being controlled equally, in particular, the same number of transistors per LED element being used for controlling the first plurality of LED elements and for controlling the second plurality of LED elements, in particular, two transistors per LED element. No special geometries for the different LED elements would therefore be needed in the ASIC, so that the manufacturing costs for the ASIC are reduced.

It may be provided that the light outlet surfaces of all LED elements are each larger in the first direction than in the second direction. The light outlet surfaces of the LED elements may be arranged in the first direction in such a way that the pixels generated by the LED elements are arranged in an angle range from −8° to 0°, in particular, in an angle range from −6° to −1°, in the vertical direction in the light distribution generated in the outer region of the motor vehicle. An illuminating device of this type may be used to project only symbols or the like into a region below the light/dark boundary, no light being projecting into the region above the light/dark boundary.

It is possible that the illuminating device comprises a projection optical element, which is not provided with an anamorphic design. By dispensing with an anamorphic design of the projection optical element, the latter may be designed more easily and more cost-effectively.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

The partially illustrated examples of an illuminating device according to the invention are designed as high-resolution headlamps. They each comprise an LED light source, which is designed as a solid-state LED array. The entire luminous surface thereof and the light outlet surface of the LED elements arranged in a matrix-like manner on the surface are illustrated schematically.

Figure 1B:
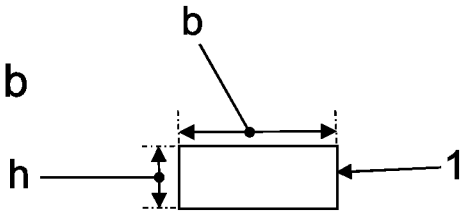
FIG. 1*b* shows a detail according to arrow 1*b* in FIG. 1*a;*
Figure 1A:
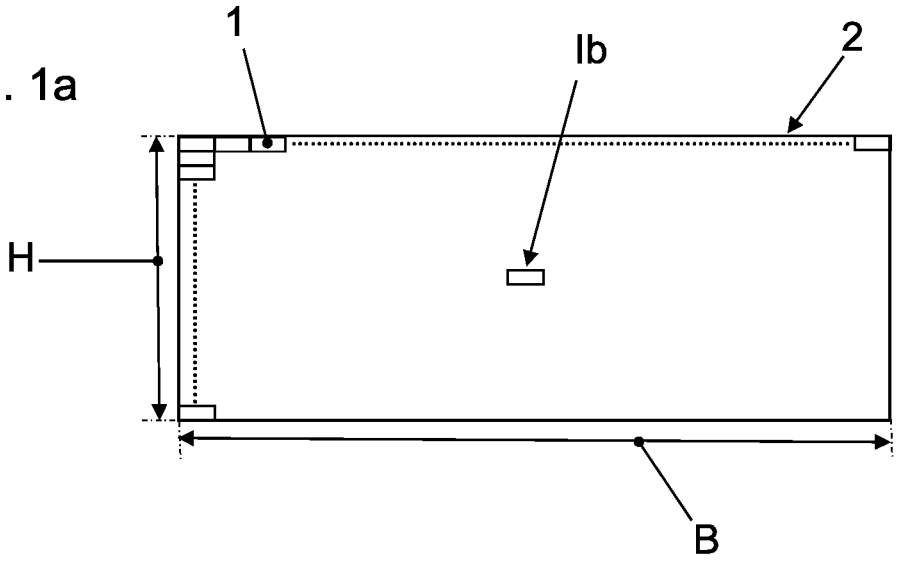
FIG. 1*a* shows a schematic top view of the luminous surface of the LED light source in an example of an illuminating device according to the invention, including light outlet surfaces of individual LED elements, which are not true to scale.

The partially illustrated illuminating device in FIG. 1*a* and FIG. 1*b* includes LED elements having light outlet surfaces 1, which are provided with a rectangular design. Dimension b in the first direction, which corresponds to the horizontal in FIG. 1*a* and in the light distribution projected into the outer region, is 50 μm. In addition, dimension h in the second direction, which corresponds to the vertical in FIG. 1*a* and in the light distribution projected into the outer region, is 20 μm (cf. FIG. 1*b*).

In the first direction, 200 LED elements having 50 μm-wide light outlet surfaces 1 are arranged side by side, so that dimension B of luminous surface 2 of the LED light source is 10 mm in the first direction. In the second direction, 200 LED elements having 20 μm-high light outlet surfaces 1 are arranged side by side, so that dimension H of luminous surface 2 of the LED light source is 4 mm in the second direction (cf. FIG. 1*a*). The number of LED elements and thus the number of pixels in light distribution 3 is 40,000.

Figure 1C:
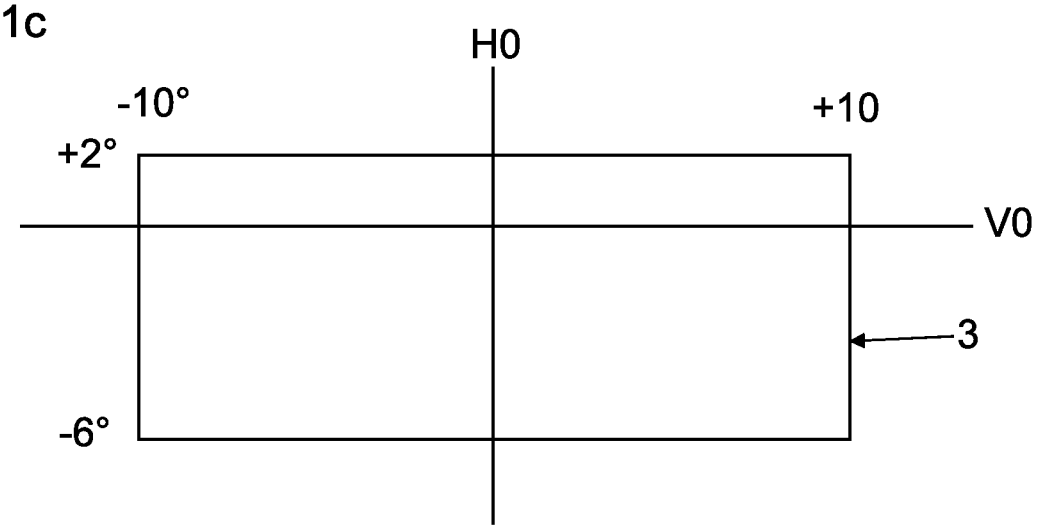
FIG. 1*c* shows a schematic illustration of a light distribution, which may be generated by the example illuminating device according to the invention.

This luminous surface 2 is transferred to a light distribution 3 by projection into the outer region, the light projection having a width in the horizontal direction corresponding to an angle range from −10° to +10°, and having a height in the vertical direction corresponding to an angle range from −6° to +2° (cf. FIG. 1*c*). The lines corresponding to an angle of 0° are each plotted with H0 and V0.

A resolution of 0.1° in the horizontal direction and 0.04° in the vertical direction result due to the number of pixels and the projection into the aforementioned angle ranges.

Figure 2B:
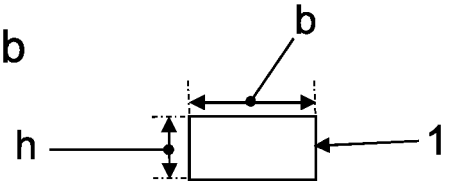
FIG. 2*b* shows a detail according to arrow IIb in FIG. 2*a;*
Figure 2A:
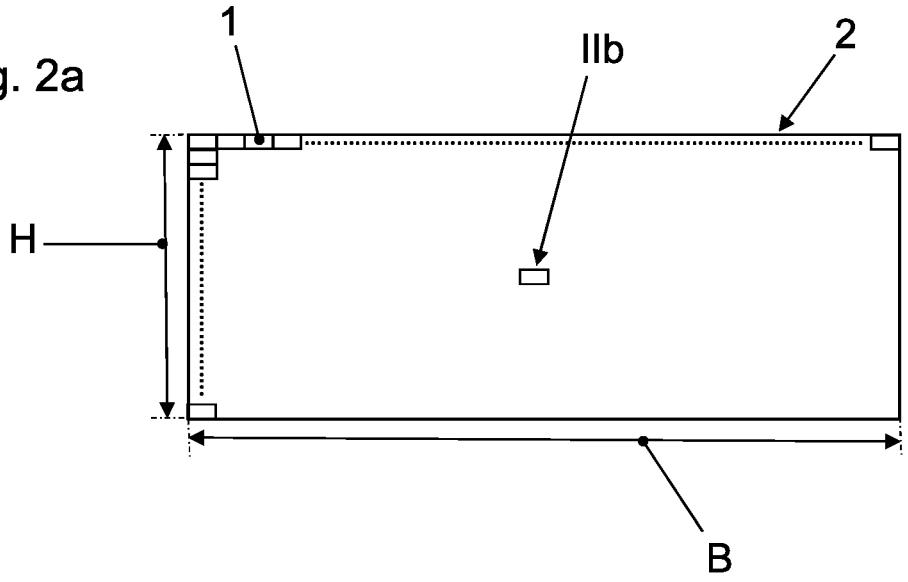
FIG. 2*a* shows a schematic top view of the luminous surface of the LED light source in an example of an illuminating device according to the invention, including light outlet surfaces of individual LED elements, which are not true to scale.

The partially illustrated illuminating device in FIG. 2*a* and FIG. 2*b* includes LED elements having light outlet surfaces 1, which are provided with a rectangular design. Dimension b in the first direction, which corresponds to the horizontal in FIG. 2*a* and in the light distribution projected into the outer region, is 40 μm. Dimension h in the second direction, which corresponds to the vertical in FIG. 2*a* and in the light distribution projected into the outer region, is 20 μm (cf. FIG. 2*b*).

In the first direction, 250 LED elements having 40 μm-wide light outlet surfaces 1 are arranged side by side, so that dimension B of luminous surface 2 of the LED light source is 10 mm in the first direction. In the second direction, 200 LED elements having 20 μm-high light outlet surfaces 1 are arranged side by side, so that dimension H of luminous surface 2 of the LED light source is 4 mm in the second direction (cf. FIG. 2*a*). The number of LED elements and thus the number of pixels in light distribution 3 is 50,000.

Figure 2C:
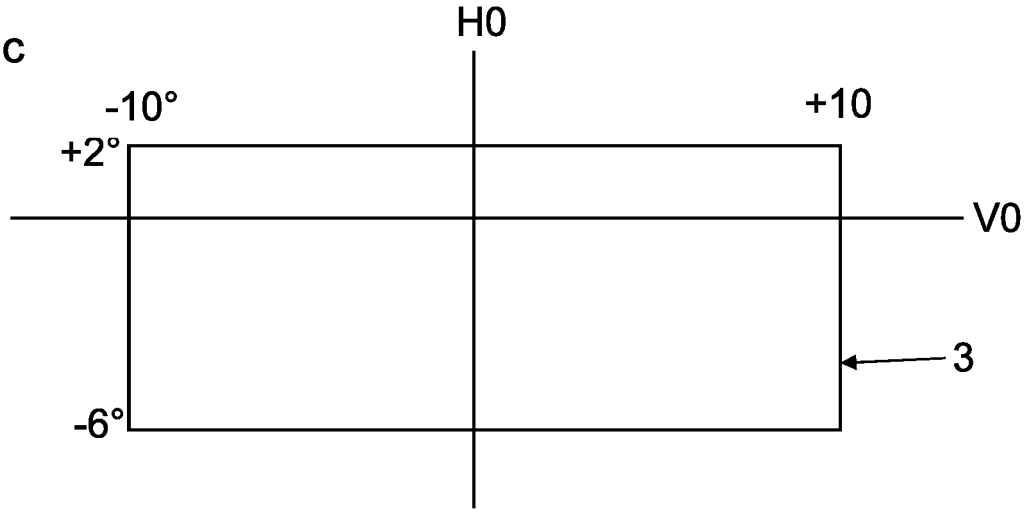
FIG. 2*c* shows a schematic illustration of a light distribution, which may be generated by the example illuminating device according to the invention.

This luminous surface 2 is transferred to a light distribution 3 by projection into the outer region, the light projection having a width in the horizontal direction corresponding to an angle range from −10° to +10°, and having a height in the vertical direction corresponding to an angle range from −6° to +2° (cf. FIG. 2*c*). The lines corresponding to an angle of 0° are each plotted with H0 and V0.

A resolution of 0.08° in the horizontal direction and 0.04° in the vertical direction result due to the number of pixels and the projection into the aforementioned angle ranges.

Figure 3B:
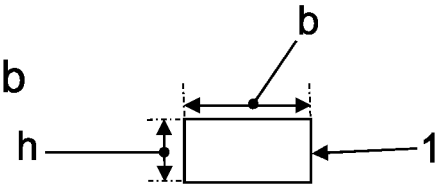
FIG. 3*b* shows a detail according to arrow IIIb in FIG. 3*a;*
Figure 3A:
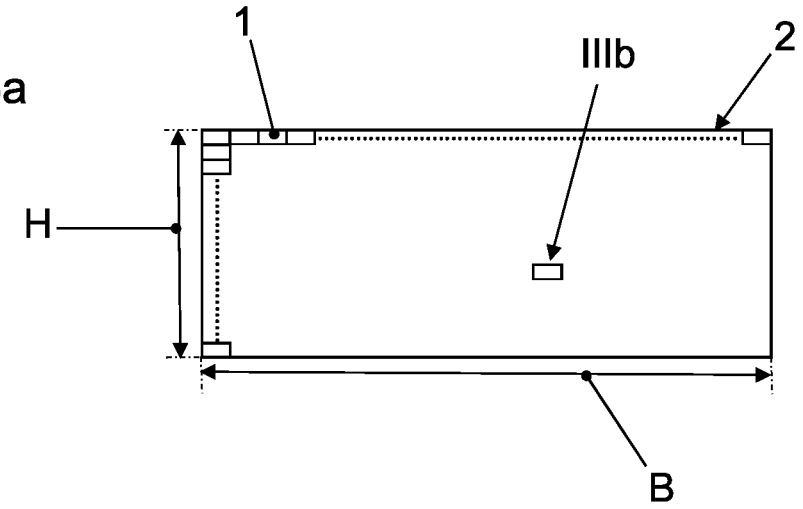
FIG. 3*a* shows a schematic top view of the luminous surface of the LED light source in an example an illuminating device according to the invention, including light outlet surfaces of individual LED elements, which are not true to scale.

The partially illustrated illuminating device in FIG. 3*a* and FIG. 3*b* includes LED elements having light outlet surfaces 1, which are provided with a rectangular design. Dimension b in the first direction, which corresponds to the horizontal in FIG. 3*a* and in the light distribution projected into the outer region, is 40 μm. Dimension h in the second direction, which corresponds to the vertical in FIG. 3*a* and in the light distribution projected into the outer region, is 20 μm (cf. FIG. 3*b*).

In the first direction, 200 LED elements having 40 μm-wide light outlet surfaces 1 are arranged side by side, so that dimension B of luminous surface 2 of the LED light source is 8 mm in the first direction. In the second direction, 160 LED elements having 20 μm-high light outlet surfaces 1 are arranged side by side, so that dimension H of luminous surface 2 of the LED light source is 3.2 mm in the second direction (cf. FIG. 3*a*). The number of LED elements and thus the number of pixels in light distribution 3 is 32,000.

Figure 3C:
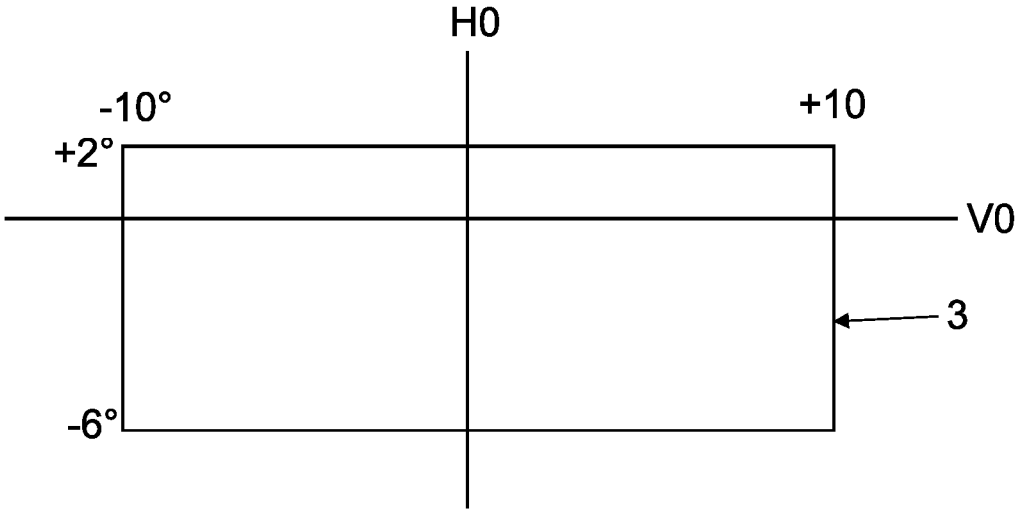
FIG. 3*c* shows a schematic illustration of a light distribution, which may be generated by the example illuminating device according to the invention.

This luminous surface 2 is transferred to a light distribution 3 by projection into the outer region, the light projection having a width in the horizontal direction corresponding to an angle range from −10° to +10°, and having a height in the vertical direction corresponding to an angle range from −6° to +2° (cf. FIG. 3*c*). The lines corresponding to an angle of 0° are each plotted with H0 and V0.

A resolution of 0.1° in the horizontal direction and 0.05° in the vertical direction result due to the number of pixels and the projection into the aforementioned angle ranges.

Figure 4B:
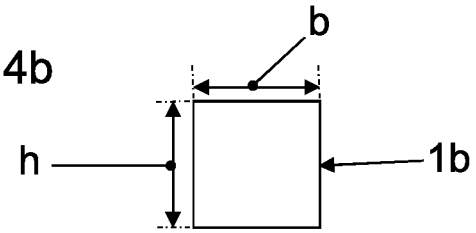
FIG. 4*b* shows a detail according to arrow IVb in FIG. 4*a;*
Figure 4A:
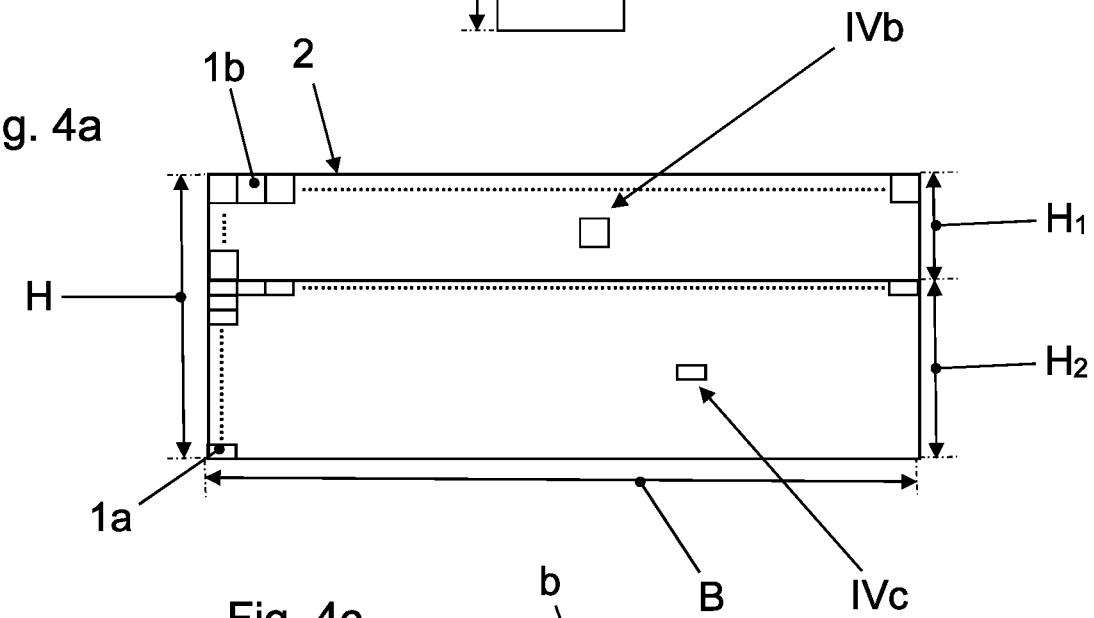
FIG. 4*a* shows a schematic top view of the luminous surface of the LED light source in an example illuminating device according to the invention, including light outlet surfaces of individual LED elements, which are not true to scale.
Figure 4C:
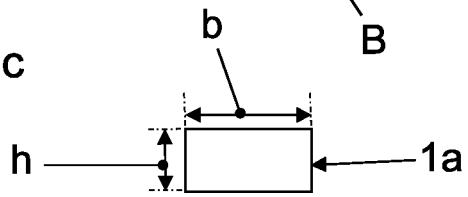
FIG. 4*c* shows a detail according to arrow IVc in FIG. 4*a;*

The partially illustrated illuminating device in FIG. 4*a*, FIG. 4*b* and FIG. 4*c* has a first plurality of LED elements in its lower part in FIG. 4*a*, which have light outlet surfaces la of a rectangular design. Dimension b in the first direction, which corresponds to the horizontal in FIG. 4*a* and in the light distribution projected into the outer region, is 40 μm. Dimension h in the second direction, which corresponds to the vertical in FIG. 4*a* and in the light distribution projected into the outer region, is 20 μm (cf. FIG. 4*c*).

The partially illustrated illuminating device in FIG. 4*a*, FIG. 4*b* and FIG. 4*c* has a second plurality of LED elements in its upper part om FIG. 4*a*, which have light outlet surfaces 1*a* of a rectangular design. Dimension b in the first direction, which corresponds to the horizontal in FIG. 4*a* and in the light distribution projected into the outer region, is 40 μm. Dimension h in the second direction, which corresponds to the vertical in FIG. 4*a* and in the light distribution projected into the outer region, is 40 μm (cf. FIG. 4*b*).

In the case of the first plurality of LED elements, 250 LED elements having 40 μm-wide light outlet surfaces 1 a are arranged side by side in the first direction, so that dimension B of luminous surface 2 of the LED light source is 10 mm in the first direction. In the case of the first plurality of LED elements, 126 LED elements having 20 μm-high light outlet surfaces 1*a* are arranged side by side in the second direction, so that dimension $H_1$, formed by the first plurality of LED elements, of lower portion 2*a* of luminous surface 2 of the LED light source is 2.52 mm in the second direction (cf. FIG. 4*a*). The number of LED elements and thus the number of pixels in a lower portion 3*a* of light distribution 3 is 31,500.

In the case of the second plurality of LED elements, 250 LED elements having 40 μm-wide light outlet surfaces 1*b* are arranged side by side in the first direction, so that dimension B of luminous surface 2 of the LED light source is 10 mm in the first direction. In the case of the second plurality of LED elements, 37 LED elements having 40 μm-high light outlet surfaces 1*b* are arranged side by side in the second direction, so that dimension $H_2$, formed by the second plurality of LED elements, of upper portion 2*b* of luminous surface 2 of the LED light source is 1.48 mm in the second direction (cf. FIG. 4*a*). The number of LED elements and thus the number of pixels in an upper portion 3*b* of light distribution 3 is 9,250.

On the whole, height H of luminous surface 2 is equal to 4 mm. In addition, the number of pixels is 40,750.

Figure 4D:
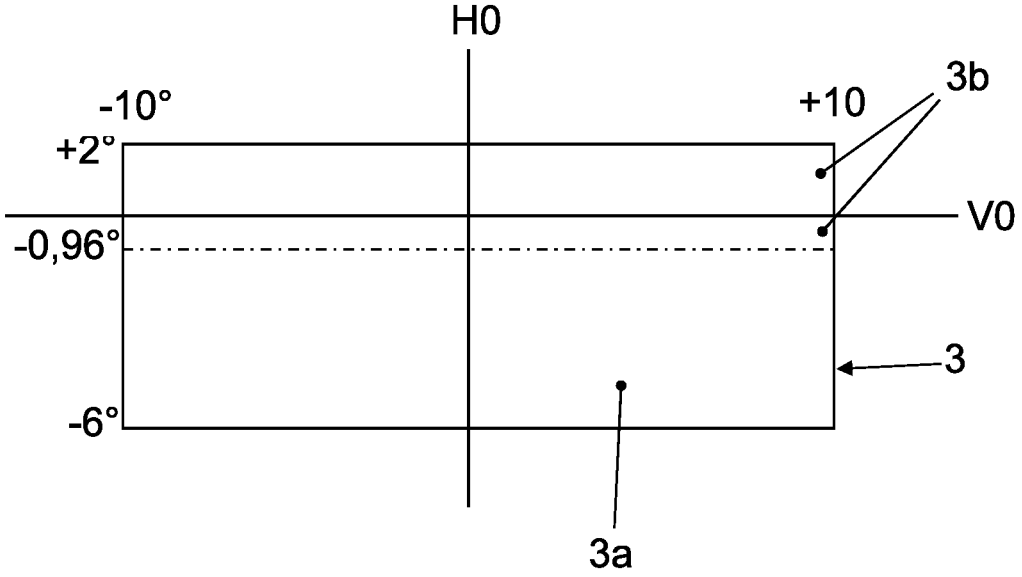
FIG. 4*d* shows a schematic illustration of a light distribution, which may be generated by the example illuminating device according to the invention.

This luminous surface 2 is transferred to a light distribution 3 by projection into the outer region, the light projection having a width in the horizontal direction corresponding to an angle range from −10° to +10°, and having a height in the vertical direction corresponding to an angle range from −6° to +2° (cf. FIG. 4*d*). The lines corresponding to an angle of 0° are each plotted with H0 and V0.

Upper portion 3*b* of light distribution 3 extends from −0.96° to +2°. Lower portion 3*a* of light distribution 3 extends from −6° to −0.96°.

A resolution of 0.08° in the horizontal direction results due to the number of pixels and the projection into the aforementioned angle ranges. A resolution of 0.08° in the vertical direction results in upper portion 3*b* of light distribution 3, and a resolution of 0.04° in the vertical direction results in lower portion 3*a* of light distribution 3.

Due to the design selected in the fourth example, particularly efficient and bright pixels may be used, which do not have to be flat, in upper portion 3*b* of light distribution 3, in particular, above the light/dark boundary, which is typically situated approximately at −0.57°. Square light outlet surfaces 1*a* of the LED elements are used for these pixels. For portion 3*a* of light distribution 3 below the light-dark boundary, flatter and wider pixels generated by rectangular light outlet surfaces 1*b* may be generated to optimize the projection of symbols.

Figure 5B:
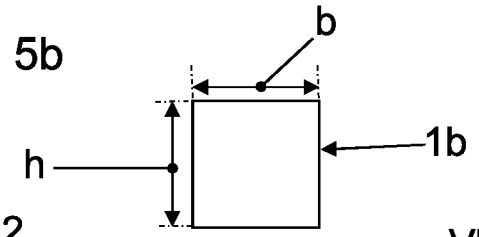
FIG. 5*b* shows a detail according to arrow Vb in FIG. 5*a;*
Figure 5A:
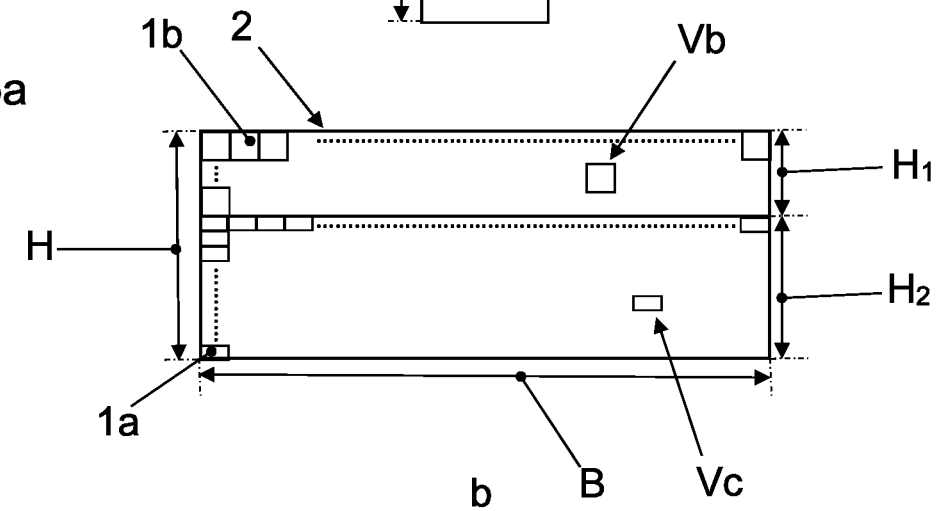
FIG. 5*a* shows a schematic top view of the luminous surface of the LED light source in an example illuminating device according to the invention, including light outlet surfaces of individual LED elements, which are not true to scale.
Figure 5C:
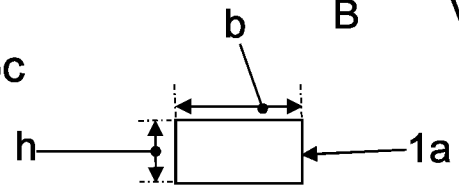
FIG. 5*c* shows a detail according to arrow Vc in FIG. 5*a;*
Figure 5D:
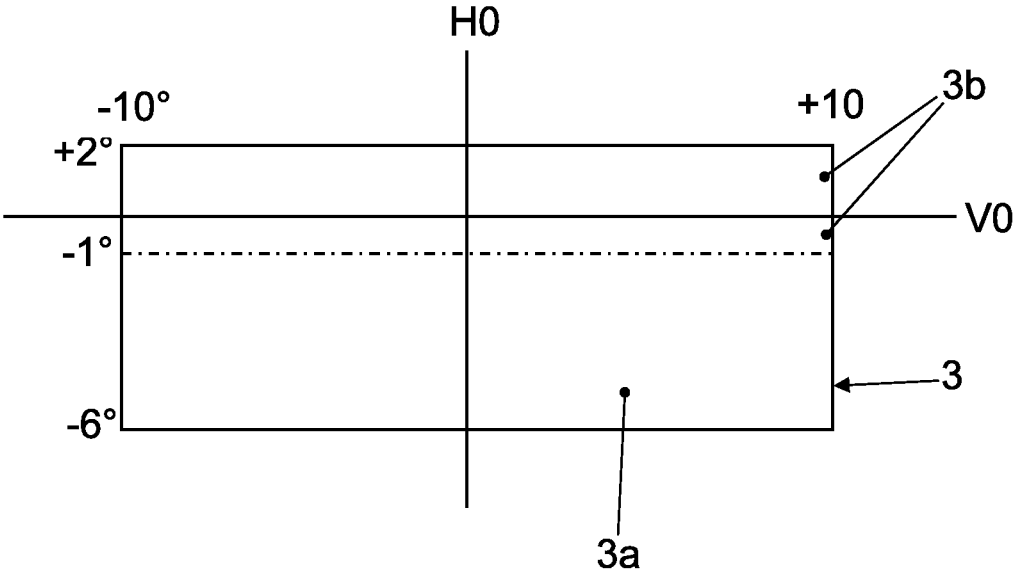
FIG. 5*d* shows a schematic illustration of a light distribution, which may be generated by the example illuminating device according to the invention.

The partially illustrated illuminating device in FIG. 5*a*, FIG. 5*b* and FIG. 5*c* has a first plurality of LED elements in its lower part in FIG. 5*a*, which have light outlet surfaces 1*a* of a rectangular design. Dimension b in the first direction, which corresponds to the horizontal in FIG. 5*a* and in the light distribution projected into the outer region, is 40 μm. In addition, dimension h in the second direction, which corresponds to the vertical in FIG. 5*a* and in the light distribution projected into the outer region, is 20 μm (cf. FIG. 5*c*).

The partially illustrated illuminating device in FIG. 5*a*, FIG. 5*b* and FIG. 5*c* has a second plurality of LED elements in its upper part in FIG. 5*a*, which have light outlet surfaces 1*a* of a square design. Dimension b in the first direction, which corresponds to the horizontal in FIG. 5*a* and in the light distribution projected into the outer region, is 40 μm. In addition, dimension h in the second direction, which corresponds to the vertical in FIG. 5*a* and in the light distribution projected into the outer region, is also 40 μm (cf. FIG. 5*b*).

In the case of the first plurality of LED elements, 200 LED elements having 40 μm-wide light outlet surfaces 1*a* are arranged side by side in the first direction, so that dimension B of luminous surface 2 of the LED light source is 8 mm in the first direction. In the case of the first plurality of LED elements, 100 LED elements having 20 μm-high light outlet surfaces 1*a* are arranged side by side in the second direction, so that dimension $H_1$, formed by the first plurality of LED elements, of lower portion 2*a* of luminous surface 2 of the LED light source is 2 mm in the second direction (cf. FIG. 5*a*). The number of LED elements and thus the number of pixels in a lower portion 3*a* of light distribution 3 is 20,000.

In the case of the second plurality of LED elements, 200 LED elements having 40 μm-wide light outlet surfaces 1*b* are arranged side by side in the first direction, so that dimension B of luminous surface 2 of the LED light source is 8 mm in the first direction. In the case of the second plurality of LED elements, 30 LED elements having 40 μm-high light outlet surfaces 1*b* are arranged side by side in the second direction, so that dimension $H_2$, formed by the second plurality of LED elements, of upper portion 2*b* of luminous surface 2 of the LED light source is 1.2 mm in the second direction (cf. FIG. 5*a*). The number of LED elements and thus the number of pixels in an upper portion 3*a* of light distribution 3 is 7,500.

On the whole, height H of luminous surface 2 is equal to 3.2 mm. In addition, the number of pixels is 27,500.

This luminous surface 2 is transferred to a light distribution 3 by projection into the outer region, the light projection having a width in the horizontal direction corresponding to an angle range from −10° to +10°, and having a height in the vertical direction corresponding to an angle range from −6° to +2° (cf. FIG. 4*d*). The lines corresponding to an angle of 0° are each plotted with H0 and V0.

Upper portion 3*b* of light distribution 3 extends from −1° to +2°. Lower portion 3*a* of light distribution 3 extends from −6° to −1°.

A resolution of 0.1° in the horizontal direction results due to the number of pixels and the projection into the aforementioned angle ranges. A resolution of 0.1° in the vertical direction results in upper portion 3*b* of light distribution 3, and a resolution of 0.05° in the vertical direction results in lower portion 3*a* of light distribution 3.

Due to the design selected in the fifth example, particularly efficient and bright pixels may also be used, which do not have to be flat, in the upper portion 3*b* of light distribution 3, in particular, above the light/dark boundary, which is typically situated approximately at −0.57°. Square light outlet surfaces 1*a* of the LED elements are used for these pixels. For portion 3*a* of light distribution 3 below the light-dark boundary, flatter and wider pixels generated by rectangular light outlet surfaces 1*b* may be generated to optimize the projection of symbols.

Figure 6A:
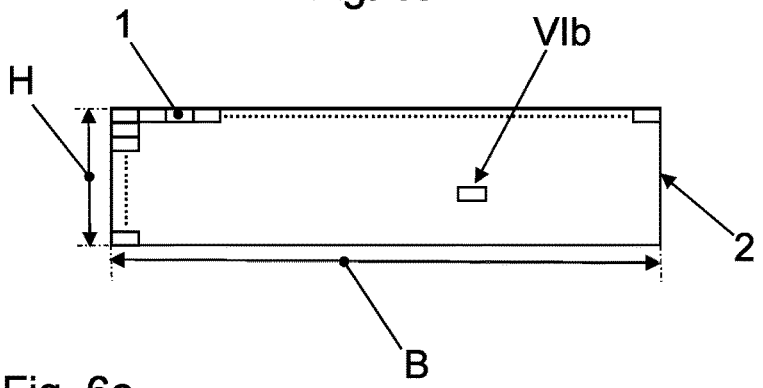
FIG. 6*a* shows a schematic top view of the luminous surface of the LED light source in an example illuminating device according to the invention, including light outlet surfaces of individual LED elements, which are not true to scale.
Figure 6B:
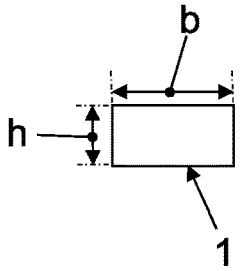
FIG. 6*b* shows a detail according to arrow VIb in FIG. 6*a;*

The partially illustrated illuminating device in FIG. 6*a* and FIG. 6*b* includes LED elements having light outlet surfaces 1, which are provided with a rectangular design. Dimension b in the first direction, which corresponds to the horizontal in FIG. 6*a* and in the light distribution projected into the outer region, is 40 μm. Dimension h in the second direction, which corresponds to the vertical in FIG. 6*a* and in the light distribution projected into the outer region, is 20 μm (cf. FIG. 6*b*).

In the first direction, 200 LED elements having 40 μm-wide light outlet surfaces 1 are arranged side by side, so that dimension B of luminous surface 2 of the LED light source is 8 mm in the first direction. In the second direction, 100 LED elements having 20 μm-high light outlet surfaces 1 are arranged side by side, so that dimension H of luminous surface 2 of the LED light source is 2 mm in the second direction (cf. FIG. 6*a*). The number of LED elements and thus the number of pixels in light distribution 3 is 20,000.

Figure 6C:
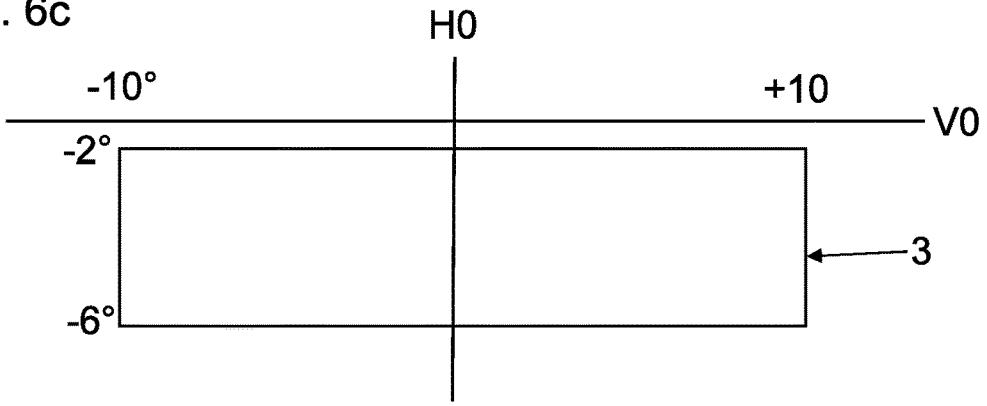
FIG. 6*c* shows a schematic illustration of a light distribution, which may be generated by the example illuminating device according to the invention.

This luminous surface 2 is transferred to a light distribution 3 by projection into the outer region, the light projection having a width in the horizontal direction corresponding to an angle range from −10° to +10°, and having a height in the vertical direction corresponding to an angle range from −6° to −2° (cf. FIG. 6*c*). The lines corresponding to an angle of 0° are each plotted with H0 and V0.

A resolution of 0.1° in the horizontal direction and 0.05° in the vertical direction result due to the number of pixels and the projection into the aforementioned angle ranges.

An illuminating device of this type may be used to project only symbols or the like into a region below the light/dark boundary, no light being projecting into the region above the light/dark boundary.

Figure 7A:
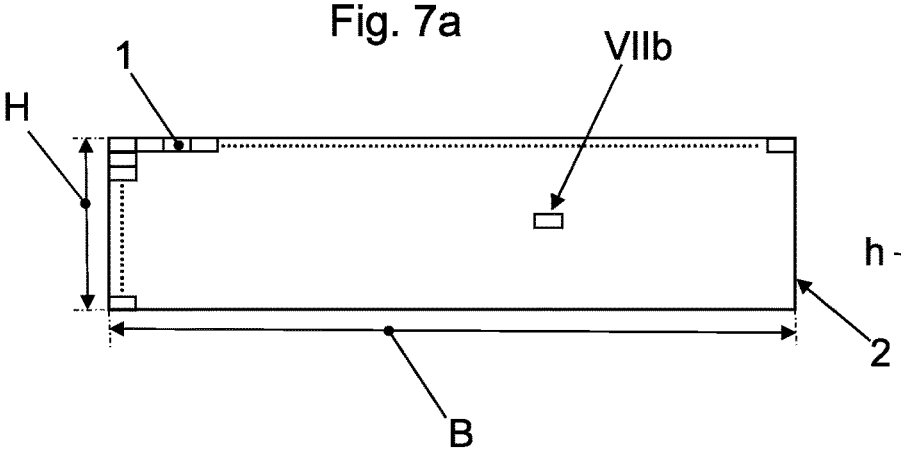
FIG. 7*a* shows a schematic top view of the luminous surface of the LED light source in an example illuminating device according to the invention, including light outlet surfaces of individual LED elements, which are not true to scale.
Figure 7B:
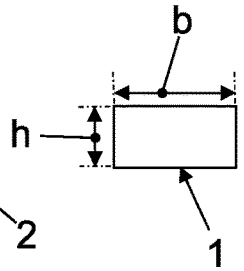
FIG. 7*b* shows a detail according to arrow VIIb in FIG. 7*a*.

The partially illustrated illuminating device in FIG. 7*a* and FIG. 7*b* includes LED elements having light outlet surfaces 1, which are provided with a rectangular design.

Dimension b in the first direction, which corresponds to the horizontal in FIG. 7*a* and in the light distribution projected into the outer region, is 40 μm. In addition, dimension h in the second direction, which corresponds to the vertical in FIG. 7*a* and in the light distribution projected into the outer region, is 20 μm (cf. FIG. 7*b*).

In the first direction, 250 LED elements having 40 μm-wide light outlet surfaces 1 are arranged side by side, so that dimension B of luminous surface 2 of the LED light source is 10 mm in the first direction. In the second direction, 125 LED elements having 20 μm-high light outlet surfaces 1 are arranged side by side, so that dimension H of luminous surface 2 of the LED light source is 2.5 mm in the second direction (cf. FIG. 7*a*). The number of LED elements and thus the number of pixels in light distribution 3 is 31,250.

Figure 7C:
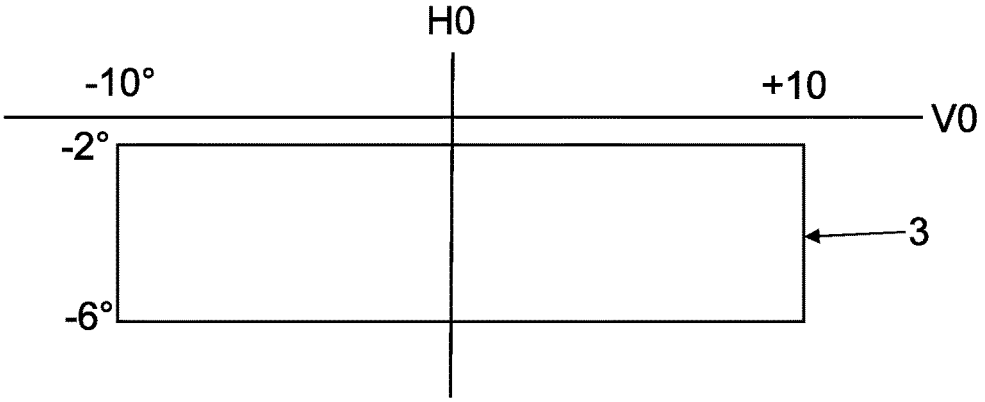
FIG. 7*c* shows a schematic illustration of a light distribution, which may be generated by the example illuminating device according to the invention.

This luminous surface 2 is transferred to a light distribution 3 by projection into the outer region, the light projection having a width in the horizontal direction corresponding to an angle range from −10° to +10°, and having a height in the vertical direction corresponding to an angle range from −6° to −2° (cf. FIG. 7*c*). The lines corresponding to an angle of 0° are each plotted with H0 and V0.

A resolution of 0.08° in the horizontal direction and 0.04° in the vertical direction result due to the number of pixels and the projection into the aforementioned angle ranges.

An illuminating device of this type may also be used to project only symbols or the like into a region below the light/dark boundary, no light being projecting into the region above the light/dark boundary.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An illuminating device for a motor vehicle, the illuminating device comprising:

an LED light source comprising LED elements, whose light outlet surfaces are used for a targeted generation of pixels of a light distribution generated in an outer region of the motor vehicle during an operation of the illuminating device, wherein the light outlet surfaces are arranged in a matrix-like manner in a first direction and in a second direction substantially perpendicular to the first direction, wherein the first direction corresponds to a horizontal direction in the light distribution generated in the outer region of the motor vehicle wherein the second direction corresponds to a vertical direction in the light distribution generated in the outer region of the motor vehicle, wherein the light outlet surfaces of each of a first plurality of the LED elements are larger in the first direction than in the second direction, and the light outlet surfaces of each of a second plurality of the LED elements are not larger in the first direction than in the second direction, such that the light outlet surfaces of the second plurality of the LED elements each have a same size in the first direction and in the second direction, wherein a luminous surface of the LED light source is formed by the light outlet surfaces of the LED elements, the luminous surface having an upper portion and a lower portion in the vertical direction, and wherein all of the light outlet surfaces of the first plurality of the LED elements are arranged in the lower portion of the luminous surface and all of the light outlet surfaces of the second plurality of the LED elements are arranged in the upper portion of the luminous surface, such that the pixels generated by the first plurality of the LED elements are arranged below the pixels generated by the second plurality of the LED elements in the vertical direction in the light distribution generated in the outer region of the motor vehicle.

2. The illuminating device according to claim 1, wherein the light distribution generated in the outer region of the motor vehicle during the operation of the illuminating device has a width in the horizontal direction which corresponds to an angle range between −7° to +7° and −15° to +15° or to an angle range from −10° to +10°.

3. The illuminating device according to claim 1, wherein the light distribution generated in the outer region of the motor vehicle during the operation of the illuminating device has a height in the vertical direction which corresponds to an angle range between −5° to −3° and −8° to +4° or to an angle range from −6° to +2°.

4. The illuminating device according to claim 1, wherein the luminous surface of the LED light source formed by the light outlet surfaces of the LED elements has an aspect ratio between 10 to 7.5 and 10 to 2.5 between the first and second directions in the outer region or an aspect ratio of 10 to 4 between the first and second directions in the outer region.

5. The illuminating device according to claim 4, wherein the luminous surface formed by the light outlet surfaces of the LED elements has a size between 15 mm2 and 50 mm2 or has a size of 40 mm2.

6. The illuminating device according to claim 1, wherein the light outlet surfaces of the first plurality of the LED elements, which are each larger in the first direction than in the second direction, have an aspect ratio between 5 to 2 and 3 to 2 between the first and second directions in the outer region or have an aspect ratio of 4 to 2 between the first and second directions in the outer region.

7. The illuminating device according to claim 1, wherein the LED light source is a solid-state LED array or comprises a solid-state LED array.

8. The illuminating device according to claim 1, wherein the light outlet surfaces of the first plurality of the LED elements are arranged in such a way that the pixels generated by the first plurality of the LED elements are arranged in an angle range from −8° to 0 in the vertical direction in the light distribution generated in the outer region of the motor vehicle.

9. The illuminating device according to claim 8, wherein the pixels generated by the first plurality of the LED elements are arranged in an angle range from −6° to −1°.

10. The illuminating device according to claim 1, wherein the light outlet surfaces of the second plurality of the LED elements are arranged in such a way that the pixels generated by the second plurality of the LED elements are arranged in an angle range from −3° to +4° in the vertical direction in the light distribution generated in the outer region of the motor vehicle.

11. The illuminating device according to claim 10, wherein the pixels generated by the second plurality of the LED elements are arranged in an angle range from −1° to +2°.

12. The illuminating device according to claim 1, wherein the illuminating device comprises an integrated circuit for controlling the the LED elements or an application-specific integrated circuit (ASIC), the first plurality of the LED elements and the second plurality of the LED elements being controlled equally or the same number of transistors per LED element being used for controlling the first plurality of the LED elements and for controlling the second plurality of the LED elements or two transistors per LED element in each case.

13. The illuminating device according to claim 1, wherein the illuminating device is a headlamp for the motor vehicle.

14. The illuminating device according to claim 1, wherein the pixels generated by the LED elements are arranged in an angle range from −6" to −1*.

15. The illuminating device according to claim 1, wherein the upper portion of the luminous surface has a smaller surface area than the lower portion, such that a smaller number of the light outlet surfaces are provided in the upper portion than the lower portion of the luminous surface.

* * * * *